United States Patent [19]

Koike et al.

[11] Patent Number: 4,937,493

[45] Date of Patent: Jun. 26, 1990

[54] CATHODE RAY TUBE WITH AN ELECTRICAL CONNECTING ELEMENT

[75] Inventors: Norio Koike; Takeo Itou; Hidemi Matsuda; Masakazu Takaki, all of Saitama, Japan

[73] Assignee: Kabushiki Kaisha Toshiba, Kawasaki, Japan

[21] Appl. No.: 290,424

[22] Filed: Dec. 27, 1988

[30] Foreign Application Priority Data

Dec. 28, 1987 [JP] Japan ..... 62-329990

[51] Int. Cl.[5] ..... H01J 29/87; H01J 29/88; H01B 1/02

[52] U.S. Cl. ..... 313/479; 358/247; 252/511

[58] Field of Search ..... 313/479, 313; 358/245, 358/246, 247; 445/8; 252/502, 503, 511, 512, 513, 514

[56] References Cited

U.S. PATENT DOCUMENTS 3,711,428 1/1973 Aycock et al. ..... 252/511 X
3,996,491 12/1976 Larson et al. ..... 313/479
4,031,553 6/1977 Sumiyoshi et al. ..... 358/247
4,563,612 1/1986 Deal et al. ..... 313/479 X

FOREIGN PATENT DOCUMENTS 118961 9/1984 European Pat. Off. .
51-127672 11/1976 Japan .
58-7751 1/1983 Japan .
62-40138 2/1987 Japan .

*Primary Examiner*—Sandra L. O'Shea
*Attorney, Agent, or Firm*—Oblon, Spivak, McClelland, Maier & Neustadt

[57] ABSTRACT

A cathode ray tube has an envelope including a faceplate with a sidewall portion and a neck receiving an electron gun emitting at least one electron beam. The faceplate is coated with a phosphor layer for emitting a visible light by bombardment of the electron beam on its inner surface and is covered with an antistatic film. To prevent accumulation of electrostatic charges, the antistatic film is electrically connected to a metal tension band wound around the sidewall portion by a connecting element. The connecting element is conductive oxide layer which essentially consists of a conductive substance and a binder consisting at least amorphous silicon oxide or silicon hydroxide.

10 Claims, 2 Drawing Sheets

CATHODE RAY TUBE WITH AN ELECTRICAL CONNECTING ELEMENT

BACKGROUND OF THE INVENTION

This invention relates to a cathode ray tube and more particular, to an electrical connecting element which electrically connects an antistatic film provided on a faceplate of the cathode ray tube to a metal tension band wound around a sidewall portion of the faceplate.

A cathode ray tube reproduces letters or images by an electron beam from an electron gun provided in a neck of the tube striking phosphor screen formed on an inner surface of a faceplate of the tube. Particularly, in a color cathode ray tube, the electron gun emits three electron beams and the phosphor screen includes three types of phosphor layers regularly arranged in the form of dots or stripes for emitting red, green and blue lights, respectively. Since the faceplate has a high surface resistance, static charges are accumulated on the faceplate due to the electron beam during operation. Because of the static charges, dust and rubbish in the air adhere to the outer surface of the faceplate, in particular, they adhere to outside the phosphor screen. Consequently, the reproduced images are difficult to see. In addition, a person receives an electrical shock when touching due to the static charges.

In order to eliminate the undesirable accumulate of static charges, it is known for the cathode ray tube that the outer surface of the faceplate is covered with an antistatic film which can reduce surface resistance of the faceplate due to its high conductivity. In this type of cathode ray tube, it is necessary to ground the antistatic film. To ground the antistatic film, a copper foil tape, which consists of a base made of rolled copper foil and a adhesive layer of a conductive adhesive covering the base, is usually used. Use of the tape gives excellent working efficiency since the tape can be easily cut at desired length and can be easilY stuck on a desired portion. However, the reliability of the tape is still unsatisfactory. More specifically, when a television set using the cathode ray tube with the tape is operated in a high temperature and a high humidity atmosphere, e.g., at temperature of 30° and relative humidity of 75%, the temperature inside the television set reaches 70° C to 80° C. Due to such severe condition, adhesivity of the tape is deteriorated and it peels away. Consequently, the antistatic film cannot operate anymore.

Japanese Laid-open patent application No. 61-16452 discloses a cathode ray tube with a antistatic film provided on the outer surface of the faceplate in a manner such that it overlaps a metal tension band wound around the sidewall portion of the faceplate in order to discharge the accumulated static charges. The antistatic film is made of silicate material including an inorganic metal salt of platinum, palladium, tin or gold. In the cathode ray tube, however, it is not possible to satisfactorily reduce the resistivity of the film even if small amount of the metal salt is added, since the film made of silicate material does not have conductivity, essentially. Further, if the much amount of the metal salt is added to the film to reduce its surface resistance, optical characteristics of the film is deteriorated such that the reproduced images are unpleasant to see.

Japanese Laid-open patent application No.62-40138 discloses a tape for electricallY, connecting the antistatic film to the metal tension band. According to the application, the tape consists of a folded aluminum tape and a reinforcing tape sandwiched between the folded tape.

Another type of the connecting tape is disclosed in Japanese Laid-open patent application No 58-7751. In accordance with the application, the tape consists of a base and a layer of adhesive material covering the base. The tape is disposed between the antistatic film and the metal tension band to suppress spurious emission from the cathode ray tube.

It is also disclosed in Japanese Laid-open patent application No.51-127672 that a conductive net is used for electrically connecting the antistatic film to the metal tension band.

SUMMARY OF THE INVENTION

One object of this invention is tO prOvide a cathode ray tube without undesirable accumulation of static charges.

Another object of the invention is to provide a cathode raY tube with excellent heat-resistance and moisture-resistance.

Further object of the invention is to provide a cathode ray tube with suppressed spurious emission.

Therefore, the invention may provide a cathode ray tube comprising an envelope including a faceplate with an inner and outer surface and a sidewall portion, a neck and a cone connecting the faceplate to the neck, an electron gun provided inside the neck for emitting at least one electron beam, a phosphor screen provided on the inner surface for emitting visible light by bombardment of the electron beam, an antistatic film provided on the outer surface for preventing accumulation of static charges on the faceplate, a metal tension band wound around the sidewall portion for preventing explosion of the envelope, and a connecting element electrically connecting the antistatic film to the metal tension band. The connecting element is conductive oxide layer essentially consisting of a conductive substance and a binder containing at least amorphous silicon oxide or silicon hydroxide.

According to the invention, since the connecting element used in the cathode ray tube is constituted by a conductive oxide layer essentially consisting of a conductive substance and a binder containing at least amorphous silicon oxide or silicon hydroxide, the element has excellent heat-resistance and moisture-resistance. Consequently, the element can realize electrically stable connection between the antistatic film and the metal tension band even if used in a high temperature and high humidity atmosphere.

Also, the connecting element has satisfactorily low surface resistance since a large amount of a conductive substance is added to the binder containing at least an amorphous silicon oxide or silicon hydroxide. The amount of conductive substance is preferable in the range from about 10wt% to about 90wt%. If the amount of the conductive substance is lower than the range the connecting element does not have satisfactory resistivity, while if it is greater than the range the element does not have sufficient strength and adhesive force. The surface resistence of the connecting element is about 10Ω or less and, in particular, its surface resistance is about IQ and the element has good conductivity if the amount of conductive substance is greater than about 30wt%.

The suitable substances, which is at least one element selected from the group consisting of aluminum, copper, nickel, carbon, silver and gold, may be used as the conductive substance.

The thickness of the connecting element is preferably in the range of from about 0.1mm to about 2mm.

The connecting element of the invention is produced in the following manner. First, a solution is prepared by dispersing a fine metal powder in an ethyl silicate solution and is adjusted to a required viscosity. Next, the solution is coated so as to bridge between the antistatic film and the metal tension band by known method, such as brush or spraying method. After this, the coated solution is heated for 5 to 10 minutes in an atmosphere at a temperature of 50° to 200° C. As the result of the heat treatment, metal alkoxides in the coated solution are converted into a connecting element in repetition of a hydrolysis polycondensation reaction.

DETAILED DESCRIPTION OF PREFERRED EMBODIMENT

Figure 1:
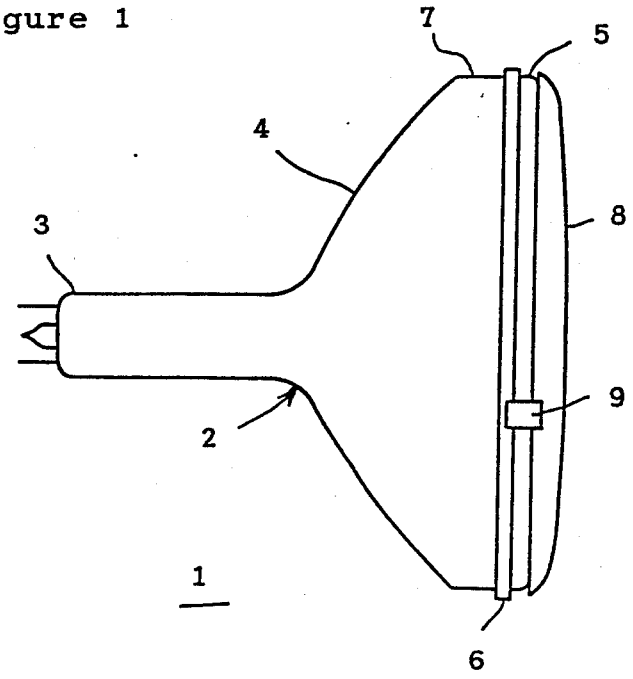
FIG. 1 shows a plane view of a cathode ray tube in accordance with one embodiment of the invention.

Preferred embodiment of this invention will be explained with reference to the drawings. In FIG. 1, a cathode ray tube 1 includes an envelope 2 which is hermetic and is made of glass. The envelope 2 has a neck 3 and cone 4 in continuation to the neck 3. The envelope 2 also has a faceplate 5 sealed with the cone 4 by frit glass. A metal tension band 6 for preventing explosion is wound around the outer periphery of a sidewall portion 7 of the faceplate 5. An electron gun (not shown) which emits three electron beams is provided in the neck 3. On the inner surface of the faceplate 5 there is provided a phosphor screen (not shown) which consists of a plurality of phosphor stripes for emitting red, green and blue light and light absorbing stripes between the phosphor stripes.

The outer surface of the faceplate 5 is covered with an antistatic film 8 to reduce surface resistance of the faceplate 5. The antistatic film 8 is electrically connected to the metal band 6 bY an electrically conductive layer 9. When the cathode ray tube is assembled into television set, the metal band 6 is electrically ground through the television set's circuit. Due to the electrically conductive layer 9, the antistatic film 8 can fulfill its functions, satisfactorily.

The cathode ray tube with the electrically conductive layer was manufactured in the following manner. First, a 14 inches size cathode ray tube with a zinc-plated metal tension band wound around the sidewall portion was prepared. The antistatic film was formed on the outer surface of the faceplate. The antistatic was formed by spray coating a solution with the composition noted below on the faceplate and sintering the coated solution for 10 minutes in an atmosphere at a temperature of 1OO° C.

| | |
|---|---|
| Ethyl Silicate | 5 wt % |
| Nitric Acid | 3 wt % |
| Water | 2 wt % |
| Isopropyl Alcohol | 89.5 wt % |

-continued

| | |
|---|---|
| Lithium Nitrate | 0.5 wt % |

The antistatic film had an average thickness of 0.15μm and the value of its surface resistance is $5\times10^8\Omega$ when measured at a temperature of 25° C and a relative humidity of 45%. For the measurement, a high resistance ohmmeter stack TR-3 manufactured by Tokyo Denshi Corporation was used.

Next, in order to form the electrically conductive layer, a solution with the composition noted below was coated by brush method and then was dried for 1O minutes in an atmosphere at a temperature of 100° C.

| | |
|---|---|
| Nickel Metal Powder | 35 g |
| Ethyl Silicate | 30 g |
| Alumina | 1 g |
| Nitric Acid | 0.5 g |
| Water | 2 g |
| Isopropyl Alcohol | 30.5 g |

By way of Comparison Example 1, a conductive tape constituted by copper foil about 0.1mm thick and about 13mm wide coated with rubber based (or acryl based) adhesive (e.g., No.1245 Copper Foil Emboss manufactured by Sumitomo 3M Limited) was used to electricallY connect the antistatic film and the metal tension band.

These cathode ray tubes were kept at following condition for a environment test, and after each test the conduction and adhesion states were investigated.

Test 1:

The cathode raY tubes were immersed in water at normal temperature for 1 hour.

Test 2:

The cathode ray tubes were left in an electric furnace at 70° C for 4 hours.

The result of the investigation is shown in Tables 1 and 2. The surface resistance valve shown in Table 1 indicates the resistance across the antistatic film and the metal tension band in the vicinity of the electrically conductive layer or the conductive tape. The resistance was measured by the TR-3.

TABLE 1

| | Surface Resistance(Ω) | | | |
|---|---|---|---|---|
| | With/Without Conductive Layer | | | |
| | Without | With | Test 1 | Test 2 |
| Example 1 | $10^{12}<$ | $5\times10^8$ | $5\times10^8$ | $5\times10^8$ |
| Comparison Example 1 | $10^{12}<$ | $5\times10^8$ | $8\times10^8$ | $5\times10^9$ |

TABLE 2

| | Test 1 | Test 2 |
|---|---|---|
| Example | No abnormality | No abnormality |
| Comparison Example 1 | No abnormality | Tendency to partial peel-off |

As seen from these results, the electrically conductive layer of this embodiment has good characteristics.

Figure 2:
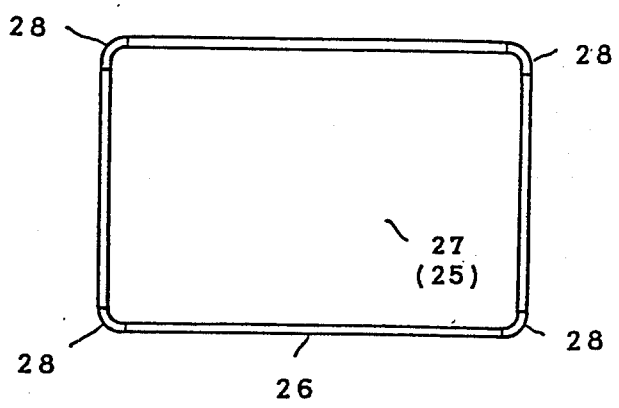
FIG. 2 shows a front view of a cathode ray tube in accordance with another embodiment of the invention.
Figure 3:
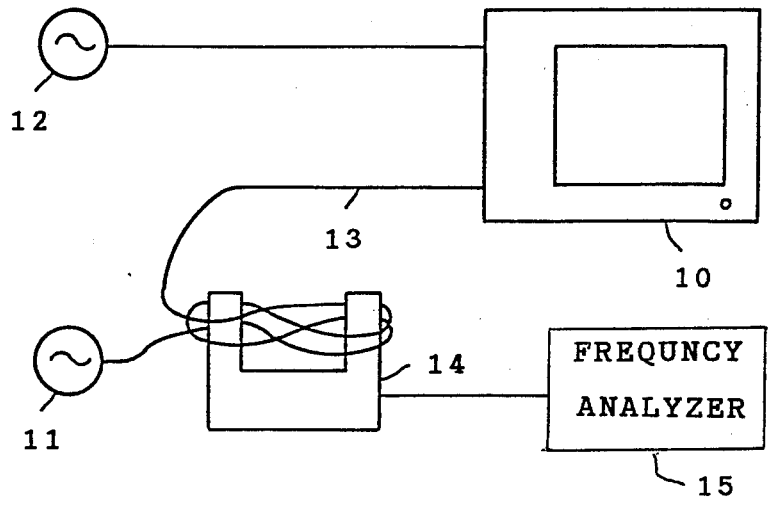
FIG. 3 shows a schematic view of a measurement equipment for measurement of spurious emission from the cathode raY tube.

As shown in FIG. 2, in order to measure the magnitude of spurious emission from a television set due to the electrically conductive layer, the electrically conductive layer 28 as described above were provided at four corners of the faceplate 25 of a 21 inches size cathode ray tube so as to establish conduction between the antistatic film 27 and the metal tension band 26. By way of comparison Examples, a cathode ray tube, which had the copper foil tape provided at four corners of the faceplate (Comparison Example 2) and a cathode ray tube, which had the copper foil tape provided at the middle of both of upper and lower long side of the faceplate (Comparison Example 3) were prepared. These cathode ray tubes were assembled into a television set and the magnitude of spurious emission from the set was measured. The result of the measurement is shown in Table 3. The magnitude of spurious emission was measured by normally practiced procedure. Namely, as shown in FIG. 3, the level of noise with a frequency of 10.75MHz, which was induced in the power supply cable 13, was measured by a known frequencY analyzer 15 via sensor 14 when predetermined signal from a signal generator 12 was applied to a television set 10, which was operated at normal voltage by an AC 1OOV power supply 11.

TABLE 3

| | Magnitude of Spurious Emission |
|---|---|
| Conventional Tube (With No Antistatic Film) | −30 dB |
| Example | −31 dB |
| Comparison Example 2 | −35 dB |
| Comparison Example 3 | −40 dB |

As seen from the result, the cathode ray tube with the electrically conductive layer of the example may reduce spurious emission same as that of the conventional cathode ray tube without the antistatic film. In addition, the cathode ray tube of the embodiment is improved compared with the cathode ray tubes using copper foil tape (Comparison Examples 2 and 3).

What is claimed is:

1. A cathode ray tube comprising:

an envelope including a faceplate with inner and outer surfaces and a sidewall portion, a neck and a cone connecting the faceplate to the neck:

an electron gun provided inside the neck for emitting at least one electron beam;

a phosphor screen provided on the inner surface of the faceplate for emitting a visible light by bombardment of the electron beam;

an antistatic film provided on the outer surface of the faceplate for preventing accumulation of static charges on the panel;

a metal tension band wound around the sidewall portion; and a connecting element electrically connecting the antistatic film to the metal tension band, the connecting element being conductive oxide layer essentially consisting of a conductive substance and a bin at least amorphous silicon oxide or silicon hydroxide.

2. A cathode ray tube according to claim 1 wherein the connecting element contains at least one conductive substance selected from the group consisting of aluminum, copper, nickel, carbon, silver and gold.

3. A cathode ray tube according to claim 1 wherein the connecting element contains about 10wt% to about 90wt% of conductive element.

4. A cathode ray tube according to claim 1 wherein thickness of the connecting element is about 0.1mm to about 2mm.

5. A cathode ray tube according to claim 1 wherein surface resistance of the connecting element is not greater than about 1OΩ.

6. A cathode ray tube comprising:

an envelope including a faceplate with inner and outer surfaces and a sidewall portion, a neck and a cone connecting the faceplate to the neck;

an electron gun provided inside the neck for emitting at least one electron beam;

a phosphor screen provided on the inner surface of the faceplate for emitting a visible light by bombardment of the electron beam;

an antistatic film provided on the outer surface of the faceplate for preventing accumulation of static charges on the panel;

a metal tension band wound around the sidewall portion; and a connecting element electrically connecting the antistaic film to the metal tension band, the connecting element being conductive oxide layer essentially consisting of a conductive substance and a binder containing at least amorphous silicon oxide or silicon hydroxide produced by hydrolysis polycondensation reaction of a silicon alkoxide.

7. A cathode ray tube according to claim 6 wherein the connecting element contains at least one conductive substance selected from the group consisting of aluminum, copper, nickel, carbon, silver and gold.

8. A cathode ray tube according to claim 6 wherein the connecting element contains about 10wt% to about 90wt% of conductive element.

9. A cathode ray tube according to claim 6 wherein thickness of the connecting element is about 0.1mm to about 2mm.

10. A cathode ray tube according to claim 6 wherein surface resistance of the connecting element is not greater than about 10Ω.

* * * * *